US011608561B2

(12) United States Patent
Donst et al.

(10) Patent No.: US 11,608,561 B2
(45) Date of Patent: Mar. 21, 2023

(54) ELECTROLYSIS DEVICE

(71) Applicant: ThyssenKrupp Uhde Chlorine Engineers GmbH, Dortmund (DE)

(72) Inventors: Dmitri Donst, Cologne (DE); Philipp Hofmann, Vienna (AT); Dirk Hoormann, Werne (DE); Gregor Damian Polcyn, Dortmund (DE); Peter Woltering, Neuenkirchen (DE); Alessandro Fiorucci, Origgio (IT); Fulvio Federico, Piacanza (IT); Michele Perego, Milan (IT)

(73) Assignee: THYSSENKRUPP UHDE CHLORINE ENGINEERS GMBH, Dortmund (DE)

( * ) Notice: Subject to any disclaimer, the term of this patent is extended or adjusted under 35 U.S.C. 154(b) by 341 days.

(21) Appl. No.: 16/645,009

(22) PCT Filed: Sep. 27, 2018

(86) PCT No.: PCT/EP2018/076205
§ 371 (c)(1),
(2) Date: Mar. 6, 2020

(87) PCT Pub. No.: WO2019/063659
PCT Pub. Date: Apr. 4, 2019

(65) Prior Publication Data

US 2020/0283919 A1 Sep. 10, 2020

(30) Foreign Application Priority Data

Sep. 29, 2017 (DE) ..... 10 2017 217 361.0

(51) Int. Cl.
*C25B 1/46* (2006.01)
*C25B 9/60* (2021.01)
*C25B 9/19* (2021.01)

(52) U.S. Cl.
CPC ..... *C25B 1/46* (2013.01); *C25B 9/19* (2021.01); *C25B 9/60* (2021.01)

(58) Field of Classification Search
CPC .... C25B 1/46; C25B 9/19; C25B 9/23; C25B 9/60
See application file for complete search history.

(56) References Cited

U.S. PATENT DOCUMENTS 4,475,999 A 10/1984 Via
4,734,180 A 3/1988 Sato
(Continued)

FOREIGN PATENT DOCUMENTS

CN 86107225 A 5/1987
CN 102459709 A 5/2012
(Continued)

OTHER PUBLICATIONS

English Translation of International Search Report issued in PCT/EP2018/076205, dated Jan. 8, 2019.

*Primary Examiner* — Salil Jain
(74) *Attorney, Agent, or Firm* — thyssenkrupp North America, LLC

(57) ABSTRACT

An electrolysis device for the electrolytic treatment of liquids has an anode chamber and a cathode chamber which are separated from one another via an ion exchange membrane. The chambers are provided with an inlet opening and an outlet opening for the flowing electrolyte, each with one electrode. The inner space of the anode chamber and/or of the cathode chamber are/is subdivided by webs or ribs extending transversely with respect to the electrodes. The webs or ribs are provided at least regionally with holes or cut outs. The webs or ribs include at least one lower region free of holes or cut outs. The electrolysis device provides sufficient mixing in the upper foam phase in the longitudinal
(Continued)

direction and also at the same time the airlift pump effect is maintained by way of ascending gas bubbles in the lower region.

14 Claims, 5 Drawing Sheets

(56) References Cited

U.S. PATENT DOCUMENTS

| | | | |
|---|---|---|---|
| 5,653,857 | A | 8/1997 | Getsy |
| 5,693,202 | A | 12/1997 | Gestermann |
| 6,125,163 | A | 9/2000 | Barth et al. |
| 6,165,332 | A | 12/2000 | Gestermann |
| 6,773,561 | B1 | 8/2004 | Noaki et al. |
| 7,323,090 | B2 | 1/2008 | Houda et al. |
| 8,444,833 | B2 | 5/2013 | Kiefer |
| 8,940,139 | B2 | 1/2015 | Asaumi et al. |
| 2003/0047447 | A1 | 3/2003 | Shimamune |

FOREIGN PATENT DOCUMENTS

| | | | | |
|---|---|---|---|---|
| CN | 101472846 | B | | 8/2012 |
| CN | 103459245 | A | | 12/2013 |
| DE | 42 24 492 | C | | 12/1993 |
| DE | 199 54 247 | A | | 5/2000 |
| DE | 696 07 1 97 | T | | 7/2000 |
| DE | 10 2004 014 696 | A | | 10/2005 |
| EP | 0 220 659 | B | | 5/1987 |
| EP | 1 580 303 | A | | 9/2005 |
| JP | 11-323584 | A | | 1/1985 |
| JP | 1998-158875 | | | 6/1998 |
| JP | 3707778 | B2 | | 10/2005 |
| JP | 4350190 | A | | 10/2009 |
| JP | 2016-174982 | A | | 10/2016 |
| JP | 2016174982 | A | * | 10/2016 |
| WO | 2004/048643 | A1 | | 3/2006 |

* cited by examiner

ELECTROLYSIS DEVICE

CROSS REFERENCE TO RELATED APPLICATIONS

This application is a U.S. National Stage Entry of International Patent Application Serial Number PCT/EP2018/076205, filed Sep. 27, 2018, which claims priority to German Patent Application No. DE 10 2017 217 361.0, filed Sep. 29, 2017, the entire contents of both of which are incorporated herein by reference.

FIELD

The present disclosure generally relates to an electrolysis device for the electrolytic treatment of liquids.

BACKGROUND

For correct functioning of the electrolysis process in the interior of the electrode chambers, the most uniform possible distribution of the electrolyte over the entire chamber height and chamber width is required, and for this reason good liquid mixing in the two electrolysis chambers is sought. In the case of chlor-alkali cells, said liquid mixing is important particularly in the anolyte chambers (anode chambers) since the ion exchange membranes work optimally only in a relatively narrow range of chloride concentration, temperature and pH. It cannot be ruled out that, in regions of the anode chamber which are unfavourable in terms of flow, a depletion of chloride occurs owing to stagnation of the anolyte, which can lead to local membrane damage.

In the anolyte chamber, a certain natural mixing occurs in the vertical direction owing to the buoyancy effect of the chlorine gas. The average flow speed in the anolyte chamber in the horizontal direction is low, and consequently the degree of natural mixing in the horizontal direction is also very low. Moreover, the gas bubbles ascending in the electrolyte tend to combine to form a closed foam layer in the upper region. Said foam formation is larger the greater the cell load is and the higher the cell is. Since the electrical resistance in the foam is higher than in the rest of the electrolyte, the current distribution over the membrane surface and thus the membrane load thereby become non-uniform.

DE 42 24 492 C1 discloses an electrolysis device having the features mentioned in the introduction, in which better liquid mixing in the two electrolysis chambers is sought. At least one dividing element, around which flow passes regionally, in the form of a dividing plate which is provided with flow guide webs is to be provided for forming a defined mixing flow in each anode chamber and/or cathode chamber. The gas bubbles which form at the electrodes are, in effect, used as conveying aids in that the distribution of the gas bubbles over the entire chamber space is prevented. Owing to the gas bubbles which form only on one side of the dividing plate in the region of the electrodes, an upwardly directed flow is generated. Since the dividing element is formed such that it is able to be washed around, the result is natural vertical circulation in the chambers.

An electrolysis device of the bipolar type which contains multiple bipolar unit cells arranged in series is described in EP 0 220 659 B1, wherein each cell is constructed from an anode-side trough-shaped body and a cathode-side trough-shaped body, each of which comprises a hook-shaped flange, a frame wall and a dividing wall, with the anode and the cathode each being welded to the dividing wall via electrically conductive ribs (webs). Each of said conductive ribs is provided over its entire height with holes, which are arranged spaced apart from one another, in order to allow passage of the electrolyte and the electrolysis product through the ribs.

In electrolysis devices of the type mentioned previously, the membrane is normally situated in each case very close to the electrodes. The ribs or webs extending between the electrodes and in the transverse direction thereto subdivide the inner space of the electrolysis device into multiple compartments. The use of solid ribs or webs can result in an insufficient supply of brine to the membrane, which leads to blister formation at the membrane when planar anodes are used.

However, on the other hand, the provision of webs with cutouts or holes over the entire height of the webs, as is proposed in EP 0 220 659 B1 cited above, in order thus to achieve improved longitudinal mixing in the entire cell chamber has the disadvantage that the desired airlift pump effect in the individual compartment of the cell chamber is no longer provided. The term "airlift pump effect" is to be understood to refer to the phenomenon described by Carl Immanuel Löscher that, by way of gas bubbles introduced into a liquid below the liquid level, the liquid level can be raised by a certain amount. This effect is used in the so-called airlift pumps for conveying liquids. Since gas bubbles form in the electrolyte during electrolysis and then ascend upwards in the liquid, the airlift pump effect occurs here, as a result of which vertical mixing of the electrolyte is realized, this being desirable to a certain degree in an electrolysis device according to the invention.

DE 696 07 197 T2 discloses an electrode arrangement for an electrolyser of the filter press type, in which use is made of anode spacers and cathode spacers which extend in the transverse direction with respect to the areal electrodes. A Z-shaped spacer is also referred to as an upper spacer, while U-shaped or C-shaped spacers are situated therebelow. However, said Z-shaped or U-shaped spacers are arranged in the electrolysis cell horizontally, however, that is to say they extend transversely with respect to the height direction of the electrolysis cell. The spacers have differently sized circular or else oval perforations. Said perforations serve for the vertical mixing of the electrolyte, wherein, as a result of the relatively large perforations, the gas flow of the gas ascending in the electrolyte should be improved. A subdivision of the electrolysis cell in the longitudinal direction, that is to say in the direction of longitudinal extent of the spacer, is not provided here.

An electrolysis cell with a gas diffusion electrode is described in DE 199 54 247 A1, in which the cell is subdivided by horizontally extending webs into multiple spaces, situated one above the other, such that the gas flows through the gas space in a meandering manner from the bottom upwards, and in the process flows in the individual spaces in each case horizontally. A further subdivision of the electrolysis cell by webs extending vertically in the height direction is not provided here.

U.S. Pat. No. 5,693,202 A likewise describes an electrochemical cell having an ion exchange membrane, in which a lower inlet opening and an upper outlet opening are provided. Extending in the cell in the transverse direction with respect to the electrodes are connection elements which extend in the horizontal direction and which subdivide the cell into multiple chambers, situated one above the other, and in which a plurality of regularly arranged openings is provided, said openings serving to allow the gas passage in the height direction of the electrolysis cell. Vertical mixing of the electrolyte is provided, whereas a further subdivision of the cell by vertically extending webs is not apparent.

Thus a need exists for an electrolysis device in which not only sufficient mixing in the longitudinal direction is provided, but also at the same time the airlift pump effect is maintained.

DETAILED DESCRIPTION

Figure 1:
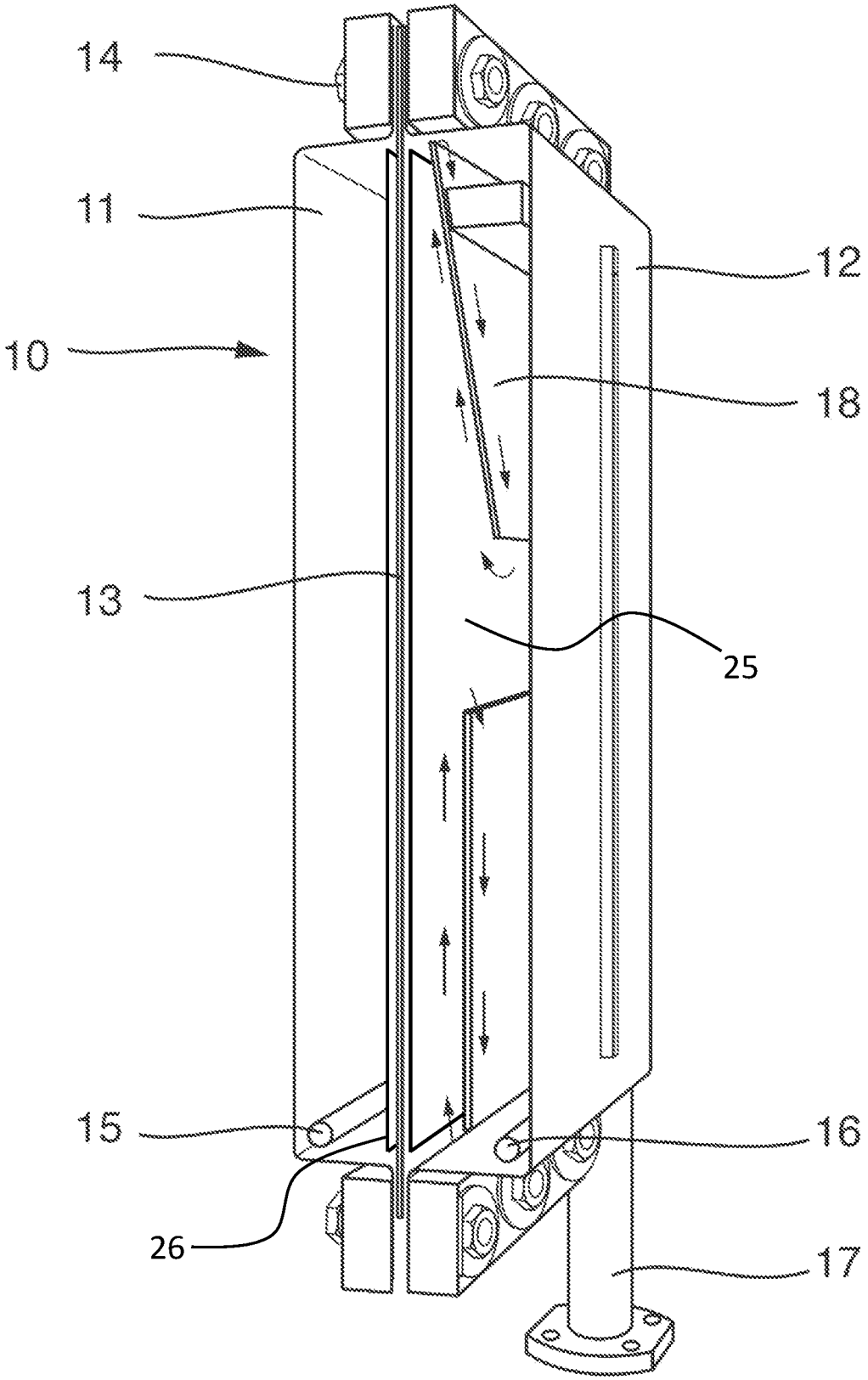
FIG. 1 is a simplified schematic view of a cross section through an exemplary electrolysis device as per a first embodiment variant.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present invention relates to an electrolysis device for the electrolytic treatment of liquids, having an anode chamber and a cathode chamber which are separated from one another via an ion exchange membrane. The chambers are provided with an inlet opening and an outlet opening for the flowing electrolyte and each with one electrode and the inner space of the anode chamber and/or of the cathode chamber are/is subdivided by webs or ribs extending transversely with respect to the electrodes, wherein the webs or ribs are provided at least regionally with holes or cutouts.

To better understand the present invention, the geometric conditions in an electrolysis cell of the type according to the invention are defined at this juncture. The electrolysis cell extends in three spatial dimensions which are each orthogonal to one another. That spatial direction in which the electrolysis cell generally has its greatest extension is defined as the "longitudinal direction". The areally formed electrodes extend in said longitudinal direction and in the height direction. The direction of the normal to the surface of the electrodes is referred to herein as the "transverse direction". Gas bubbles ascend in the electrolysis cell from the bottom upwards counter to the force of gravity. This direction from the bottom upwards is referred to herein as the "height direction".

The conventional mixing of the electrolyte in the height direction, which mixing is also provided in the prior art, is referred to as "vertical mixing" in the present application. The mixing of the electrolyte in the longitudinal direction of the electrolysis cell, for which purpose the vertical webs provided according to the invention have holes or cutouts through which the electrolyte is able to flow, is to be differentiated from this. Said webs thus extend in the height direction of the electrolysis cell according to the above definition or substantially in the vertical direction, wherein they also extend in the transverse direction of the electrolysis cell, that is to say transversely with respect to the areal electrodes. Thus, as a result of said webs, a subdivision of the electrolysis cell in its longitudinal direction into multiple compartments is provided. The flow of the electrolyte through holes or cutouts in these webs is thus substantially a flow in the longitudinal direction of the electrolysis cell and is also referred to herein as "horizontal mixing".

The terms "bottom" and "top" used herein refer to the extent of the electrolysis cell in the height direction. Thus, within the context of the present invention, an "upper" region is, when viewed in the height direction of the electrolysis cell, situated higher up than a "lower" region.

According to the invention, it is provided that the webs or ribs extend in the height direction of the electrolysis device and comprise, as viewed in the height direction, at least one lower region in which they are free of holes or cutouts, that is to say that no holes or cutouts are provided in said region. By virtue of the fact that, in the lower region, the webs or ribs are solid and comprise no holes or cutouts, an unobstructed airlift pump effect is ensured in said region. It is thus possible in the lower region for the gas bubbles which form during the electrolysis to ascend upwards without obstruction in the compartment, separated by the web, of the electrolysis cell. Vertical flow predominates in this lower region, and there is no significant longitudinal mixing of the electrolysis medium here. By contrast, holes or cutouts are, according to the invention, present in the upper region of the webs or ribs. In this upper region, a foam phase of the electrolysis medium is formed by way of the ascending gas bubbles, and longitudinal mixing is therefore desirable here. Said longitudinal mixing is achieved by way of the holes or cutouts in the webs or ribs, which holes or cutouts permit throughflow of the electrolysis medium into the adjacent compartment of the electrolysis cell.

The direction in which the electrodes extend is to be understood as the "longitudinal direction" of the electrolysis device in the present application. If it thus stated herein that the webs or ribs extend transversely with respect to the electrodes, then this is intended to mean that the webs or ribs substantially extend in the transverse direction of the electrolysis device and preferably approximately at right angles to the electrodes. The two electrolysis chambers generally each comprise an approximately cuboidal inner space, which accommodates the electrolyte. Thus, within the meaning of the above definitions, the webs or ribs extend in the electrolysis cell substantially in the vertical direction and in the transverse direction. The vertical mixing, which is also provided in conventional electrolysis cells, corresponds to a flow of the electrolyte substantially parallel to the webs or ribs, that is to say to a flow in the height direction of the electrolysis cell in the individual compartments between in each case two webs or ribs. By contrast, with the longitudinal mixing described in the present application, the electrolyte flows through the holes of a web in a substantially horizontal direction, and so the electrolyte flows from one compartment into an adjacent compartment through holes of a web. The longitudinal mixing is thus realized in a substantially horizontal flow direction which is oriented basically orthogonal to the vertical mixing in the height direction, that is to say orthogonal or at least transverse to the gas bubbles ascending in the electrolyte.

The term "holes", which is used herein, does not include any limitation to a specific contour shape. The holes may for example have a circular, oval, elongate or polygonal contour. The term "cutouts", which is used herein, comprises firstly continuous holes, which have any desired contour shape and are surrounded on all sides by the material of a web, and also however perforations of the material, which permit passage of the electrolysis medium but are not surrounded on all sides by the material of a web, that is to say they may, if appropriate, also be open at one or more points on their periphery.

As a result of the configuration according to the invention of the webs or ribs, two effects are thus advantageously combined with one another. Firstly, the airlift pump effect is obtained in the lower region of the webs (which leads to transverse mixing), and secondly longitudinal mixing is still realized in the upper region of the webs. Consequently, optimal mixing of the inflow and transported brine at the anode is ensured over the entire cell height by the airlift pump effect, and at the same time optimal brine transport at the anode is achieved over the cell width by way of the holes or cutouts in the webs in the upper foam phase. In this way, damage to the diaphragm, which otherwise occurs as a result of an insufficient supply of NaCl if, for example, chlor-alkali electrolysis is carried out in the electrolysis cell, is prevented. Such an insufficient supply of brine to the membrane promotes the formation of blisters at the membrane, which can be observed in particular during operation with permanently high current densities.

One preferred refinement of the solution to the object according to the invention provides that the webs or ribs comprise, as viewed in the height direction of the electrolysis cell, at least one upper region with holes or cutouts. As a result of these holes or cutouts in the upper region of the webs or ribs, longitudinal mixing is possible there. In said region, a foam phase is formed by the ascending gas bubbles, in the region of which phase longitudinal mixing of the electrolyte is advantageous.

Preferably, the lower region, in which the webs or ribs comprise no holes or cutouts, extends at least approximately over the lower half of the entire height of the webs or ribs, in particular at least over the lower half of the entire height of the webs or ribs. The end of the lower region is of course dependent on the individual conditions in the respective electrolysis cell. For example, it can be determined empirically up to which height of the webs the airlift pump effect is desired and longitudinal mixing should be prevented, and at which height in each case the foam phase begins. Experiments have revealed that it is generally advantageous for at least approximately the lower half of the webs or ribs, in particular at least the lower half of the webs or ribs, to be of solid form, that is to say formed without holes or cutouts. The region in which the holes begin can therefore vary in particular cases for example in dependence on the parameters of the electrolysis cell, on the type of the electrolyte used in each case and on the conditions under which electrolysis takes place, such as temperature, pH, current density, etc.

One preferred refinement of the invention provides that the lower region, in which the webs or ribs comprise no holes or cutouts, extends at least approximately over the lower two thirds, in particular over the lower two thirds, of the entire height of the webs or ribs. In this possible variant, the region in which the webs or ribs are of solid form thus extends upwards beyond the middle of the webs or ribs, while holes or cutouts are provided only approximately in the upper third, in particular in the upper third, at the place where the foam phase is formed.

According to one preferred refinement of the invention it is provided that the upper region, in which the webs or ribs comprise holes or cutouts, extends at least approximately over the upper quarter, in particular over the upper quarter, of the entire height of the webs or ribs. In this possible variant, the region in which the webs or ribs are of solid form thus extends further upwards, while holes or cutouts are provided at least approximately in the upper quarter, in particular in the upper quarter, at the place where the foam phase is formed.

Particularly preferably, the upper region, in which the webs or ribs comprise holes or cutouts, extends at least approximately over the upper third of the entire height of the webs or ribs, in particular at least over the upper third of the entire height of the webs or ribs.

One preferred refinement of the invention provides that the webs or ribs comprise, in the at least one upper region, multiple holes or cutouts which are spaced apart from one another by solid regions in the height direction of the webs or ribs.

A further preferred refinement of the device according to the invention provides that the webs or ribs comprise, in the at least one upper region, holes which have an at least partially approximately circular contour. At this juncture, mention is made, merely by way of example, of a keyhole. However, any other desired contour shapes for the holes or cutouts are in principle also conceivable. For example, it is possible to provide holes or cutouts with different contour shapes and of different sizes, for example depending on the desired intensity of the longitudinal mixing effect and on the volume of electrolyte which should flow through the holes or cutouts in each case into the adjacent compartment per unit time.

A further preferred refinement of the invention provides that the webs or ribs comprise, in the at least one upper region, multiple holes or cutouts which, as viewed in the direction of the height of the webs or ribs, have different spacings from one another. This offers a further possibility for varying the mixing effect in the longitudinal direction in that, although use is made of holes or cutouts of in each case approximately equal size, the spacings thereof from one another vary over the height of the webs or ribs, so that for holes or cutouts which are arranged closer to one another, larger total areas of holes per unit area of the webs are provided. A similar effect may of course also be realized if use is made of differently sized holes or cutouts. However, owing to the width of the webs or ribs, an upper limit for the diameter or the width of the holes or cutouts exists for reasons of mechanical stability of the webs alone, so that in this case larger hole areas for the longitudinal mixing can be realized via an arrangement of the holes with the latter closer together.

For example, the holes or cutouts in the webs or ribs, in a first lower section of the upper region, may be arranged with smaller spacings from one another than in an second section of the upper region adjoining towards the top.

Within the framework of the present invention, it is advantageous for the holes or cutouts to be of a specific minimum size in order to achieve the desired mixing effect. Thus, the free cross section of at least one hole or cutout preferably amounts to at least approximately 10 $mm^2$, particularly preferably at least approximately 15 $mm^2$. Preferably, the free cross section of all holes or cutouts amounts to at least approximately 300 $mm^2$ in total and the individual holes have the aforementioned minimum cross sections, wherein this also depends on the number of holes or cutouts provided in total and the spacing thereof from one another in each case.

A further subject of the present invention is a method for the electrolytic treatment of a flowable medium in an electrolysis device having the features of one of claims 1 to 10.

Preferably, the method according to the invention comprises chlor-alkali electrolysis. Electrolysis devices of the type described herein are suitable in a particular way for chlor-alkali electrolysis. However, the electrolysis devices according to the invention may also be used for other electrolysis processes.

Below, the basic structure of an electrolysis device of said type is explained in more detail with reference to FIG. 1. Generally, an electrolysis cell 10 comprises in each case one housing having two half-shells, namely a cathode half-shell 11 and an anode half-shell 12, which are each provided at the top and bottom with flange-like edges between which in each case one membrane 13 is clamped by means of seals. Said membrane 13 forms a dividing wall between the cathode half-shell 11 (which corresponds to the cathode chamber or catholyte chamber) and the anode half-shell 12 (which corresponds to the anode chamber or anolyte chamber). The cathode half-shell 11 and the anode half-shell are connected to one another at the top and bottom, in each case in the region of their flange-like edges, via screws 14, which are oriented in the transverse direction, to form an electrolysis cell 10. In the lower region, in each of the two half-shells 11, 12, in each case one inlet distributor tube 15, 16 for electrolyte solution extends in the longitudinal direction of the electrolysis cell, and consumed electrolyte is discharged from the electrolysis cell via an outlet tube 17. As shown at least schematically in FIG. 1, the anode 25 (i.e., a positively charged electrode) and the cathode 26 (i.e., a negatively charged electrode) each extend in a planar manner in the vertical direction close to the membrane 13 in the respective half-shell 12, 11, but have been omitted from FIGS. 2-5 to avoid obstructing other components.

As can be seen in FIG. 1, an obliquely oriented guide plate 18 is provided in the anode half-shell in the upper region such that, on that side of said guide plate 18 which faces the anode 25, gas-laden liquid ascends in the direction of the arrows and, on the rear side of the guide plate, the liquid which is laden with gas to a lesser extent or is not laden with gas at all descends. This results in circulation of the anolyte in the lower region, which leads to vertical mixing. Said circulation compensates for the concentration differences in electrolyte (for example NaCl) between the inflow and the liquid in the cell.

Figure 2:
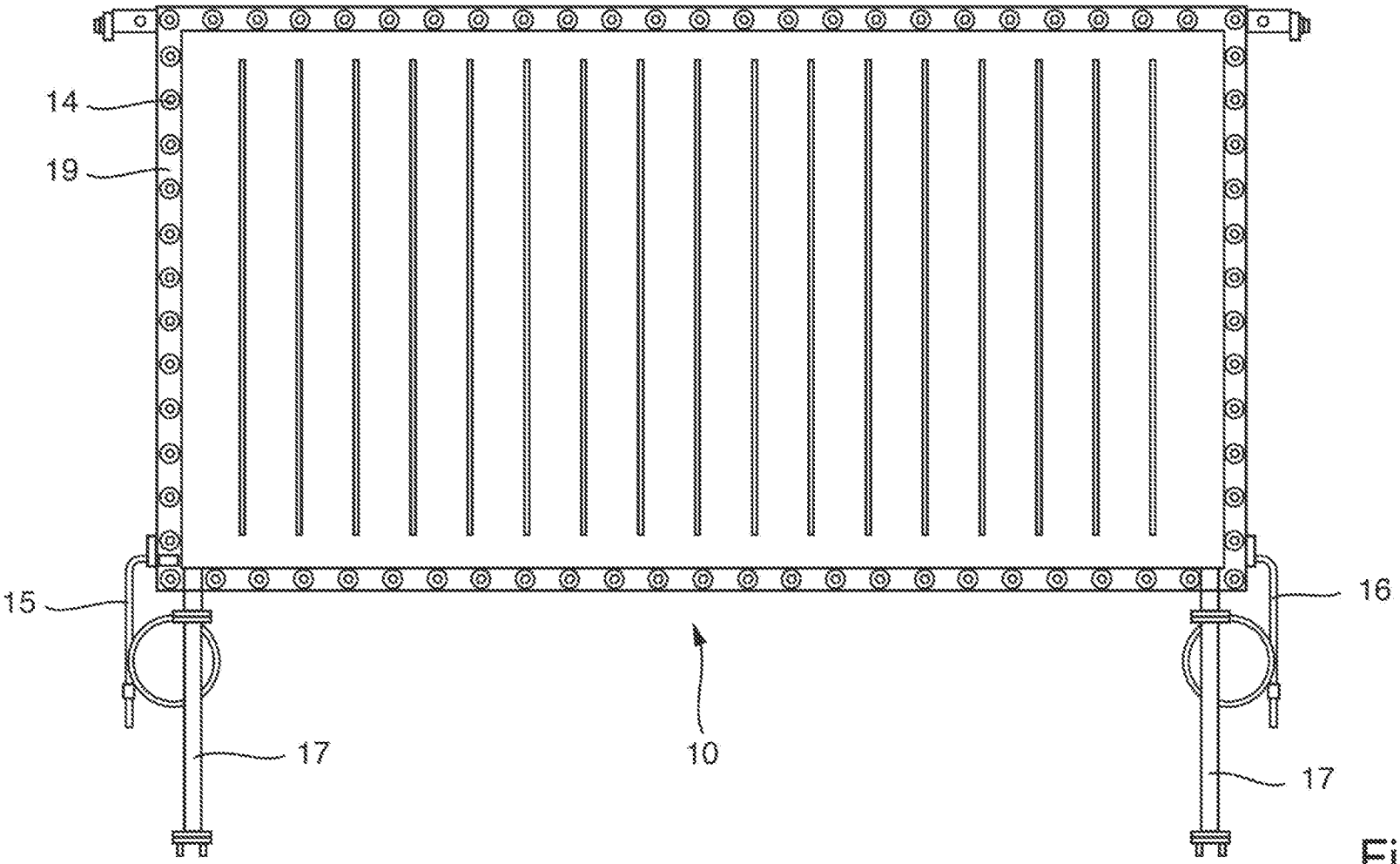
FIG. 2 is a longitudinal view of an exemplary electrolysis device.

In the view of an electrolysis cell as per FIG. 2, the two inlet distributor tubes 15, 16 for the two half-shells, and the outlet tubes 17 which are each assigned to one half-shell, can be seen. The peripheral frame 19, in the region of which the flange-like edges of the two half-shells are screwed to one another, can furthermore be seen in FIG. 2.

Figure 3:
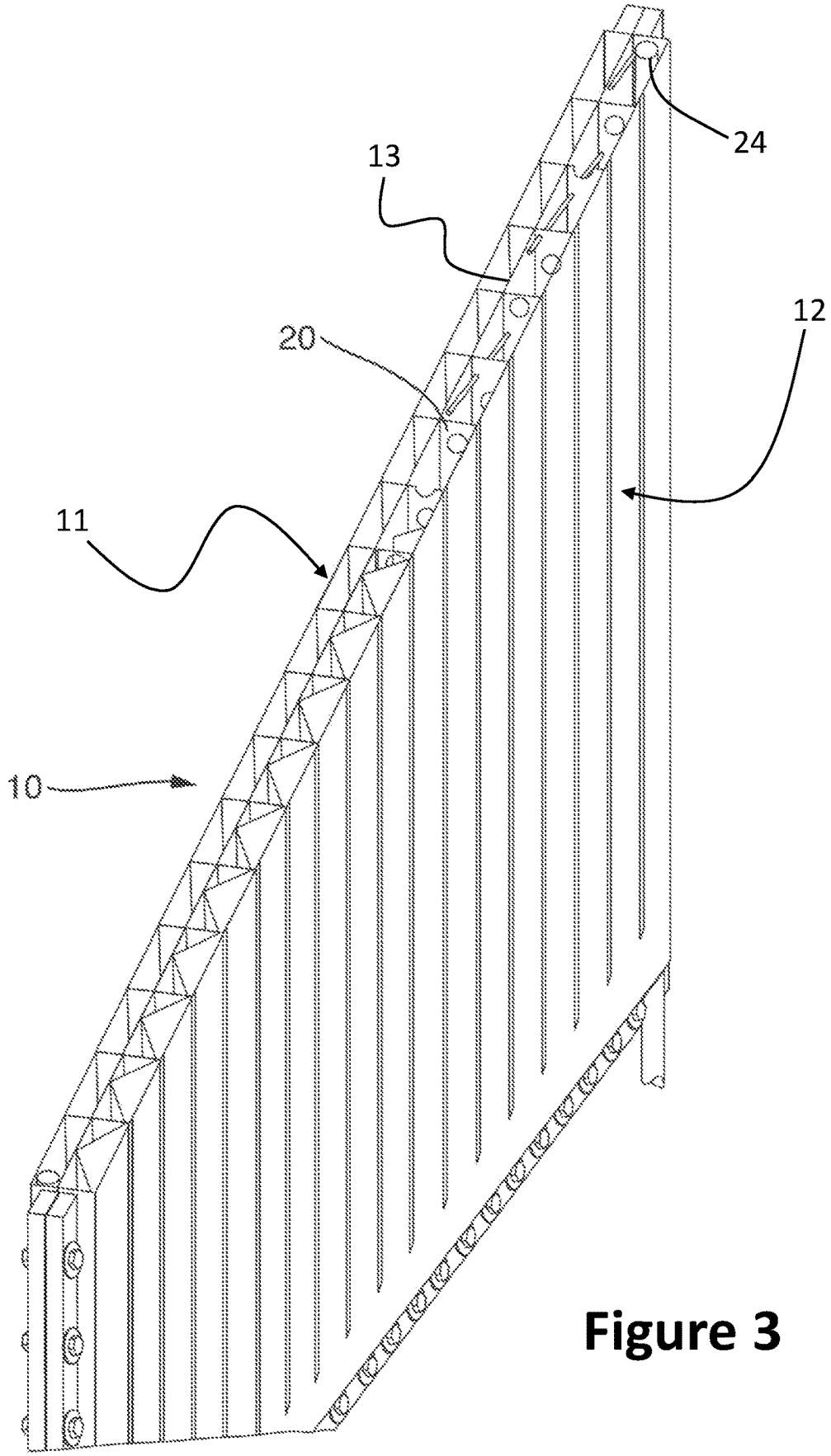
FIG. 3 is a sectional view in the longitudinal direction of the electrolysis device illustrated in FIG. 2.
Figure 4:
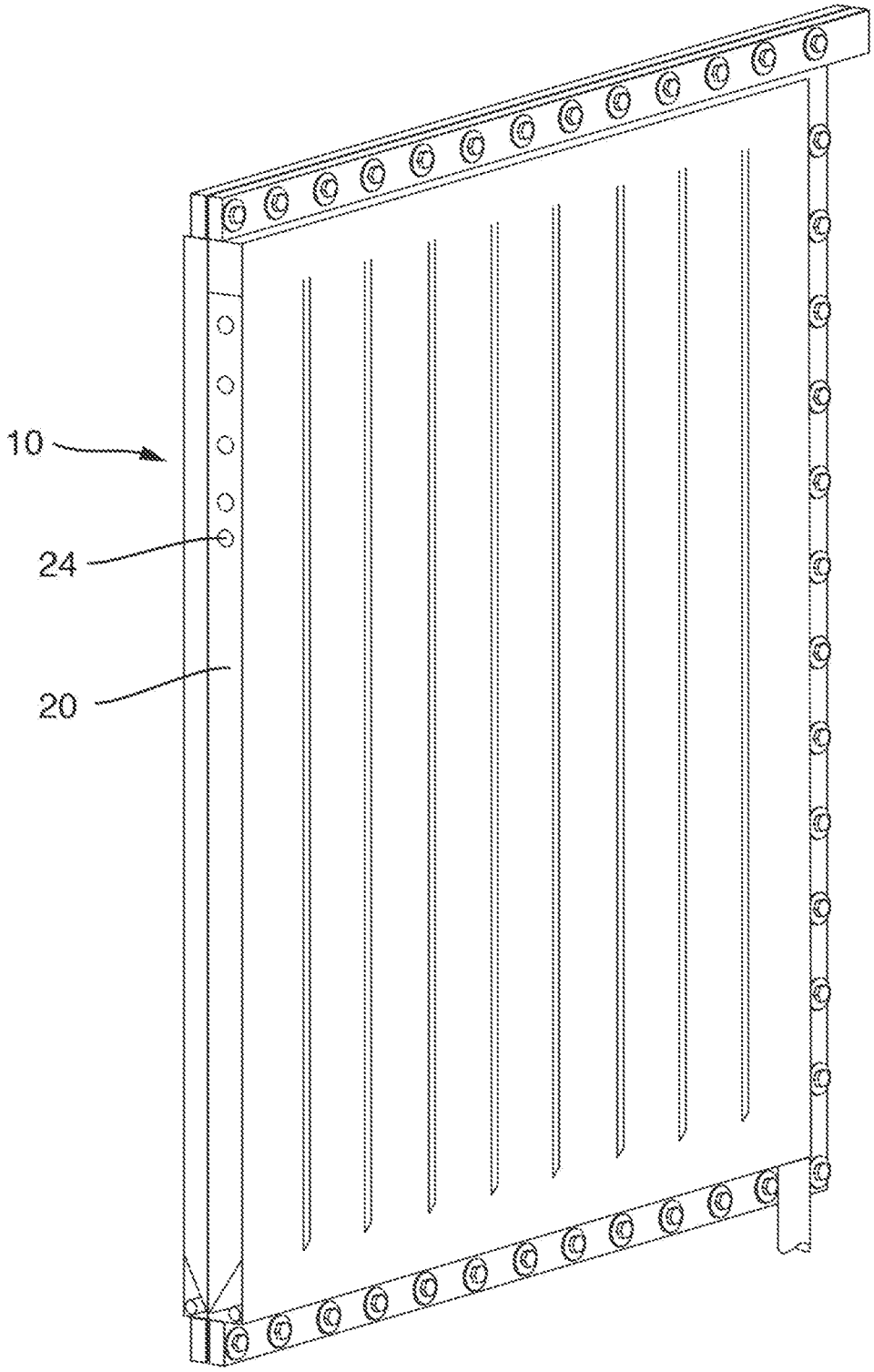
FIG. 4 is a sectional view in the transverse direction of the electrolysis device illustrated in FIG. 2.

The electrolysis cell illustrated in FIG. 2 is illustrated cut open in the longitudinal direction in FIG. 3. Here, it can be seen that, in the case of electrolysis cells of this type, the rear space of the two electrodes in both half-shells is in each case subdivided into individual compartments by webs 20 extending in an approximately vertical direction and in the transverse direction. Said webs also serve for the reinforcement and support of the cathode and anode. In the cross-sectional view as per FIG. 4, one of said webs 20 can be clearly seen in the drawing, on the left-hand side. It can be seen that the web 20 is provided in the upper region with holes 24 via which longitudinal mixing of the electrolyte is realized. Further details concerning the formation and function of said webs 20 will be explained in more detail below on the basis of the individual-part drawing as per FIG. 5.

Figure 5:
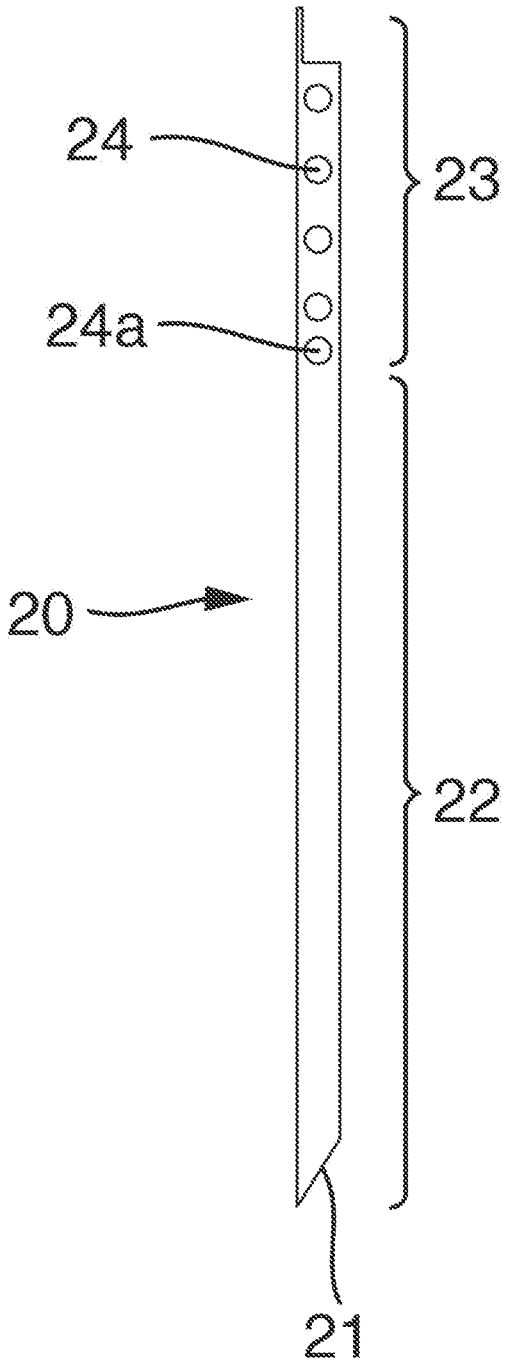
FIG. 5 is a detailed view of an individual web with the holes for the longitudinal mixing of the electrolyte.

The illustration as per FIG. 5 shows an individual web 20 which is bevelled in its lower end region 21 and thus continuously tapers in its width towards the lower end. As viewed in the direction of its height, said web has in principle two differently formed regions, namely a lower region 22 and an upper region 23. The lower region 22 is solid, with no holes or cutouts being provided therein. In the exemplary embodiment as per FIG. 5, said lower region 22 extends over slightly more than the lower two thirds of the entire height of the web 20. The upper region 23 of the web 20 adjoins the lower region 22 towards the top, with the web 20 being provided in said upper region 23 with holes 24 through which electrolyte can pass in the longitudinal direction of the electrolysis cell such that longitudinal mixing of the electrolyte is realized in said upper region 23. There, a foam phase of the electrolyte is situated as a result of the ascending gas bubbles.

As can be seen in FIG. 5, a number of multiple holes 24 spaced apart from one another are provided. In the exemplary embodiment, five such holes 24 are illustrated by way of example. It can furthermore be seen that the two lower holes 24 a as viewed in the height direction of the web 20 have a smaller spacing from one another than the upper holes. The number of the holes 24 and their respective spacings from one another may be varied more or less in any desired manner within the scope of the present invention.

LIST OF REFERENCE SIGNS

10 Electrolysis cell
11 Cathode half-shell
12 Anode half-shell
13 Membrane
14 Screws
15 Inlet distributor tube
16 Inlet distributor tube
17 Outlet tube
18 Guide plate
19 Peripheral frame
20 Webs
21 Lower end region, bevelled
22 Lower region, solid
23 Upper region, with holes
23 Holes
24 a Lower holes, with relatively small spacings
Anode 25
Cathode 26

What is claimed is:

1. An electrolysis device for the electrolytic treatment of liquids, the device comprising:

an anode chamber including at least one inlet opening and one outlet opening configured to permit the flow of electrolyte and with at least one electrode;

a cathode chamber including at least one inlet opening and one outlet opening configured to permit the flow of electrolyte and with at least one electrode; and an ion exchange membrane separating the anode chamber from the cathode chamber;

wherein the inner space of the anode chamber and/or of the cathode chamber are/is subdivided by webs extending transversely with respect to the electrodes, wherein the webs are provided at least regionally with holes, and wherein the webs extend in the height direction of the electrolysis device and comprise, as viewed in the height direction, at least one lower region in which the webs are free of holes.

2. The electrolysis device of claim 1 wherein the webs comprise, as viewed in the height direction, at least one upper region with holes.

3. The electrolysis device of claim 1 wherein the lower region, in which the webs are free of holes, extends at least approximately over the lower half of the entire height of the webs.

4. The electrolysis device of claim 1 where the lower region, in which the webs are free of holes, extends at least approximately over the lower two thirds of the entire height of the webs.

5. The electrolysis device of claim 1 wherein the upper region, in which the webs comprise holes, extends at least approximately over the upper quarter of the entire height of the webs.

6. The electrolysis device of claim 1 wherein the upper region, in which the webs comprise holes, extends at least approximately over the upper third of the entire height of the webs.

7. The electrolysis device of claim 2 wherein the webs comprise, in the at least one upper region, multiple holes which are spaced apart from one another by solid regions in the height direction of the webs.

8. The electrolysis device of claim 2 wherein the webs at least partially have, in the at least one upper region, holes which have an approximately circular contour.

9. The electrolysis device of claim 2 wherein the webs comprise, in the at least one upper region, multiple holes which, as viewed in the direction of the height of the webs, have different spacings from one another.

10. The electrolysis device of claim 9 wherein the holes in the webs, in a first lower section of the upper region, are arranged with smaller spacings from one another than in a second section of the upper region adjoining a top thereof.

11. The electrolysis device of claim 1 wherein the free cross section of at least one of the holes is at least approximately 10 $mm^2$.

12. The electrolysis device of claim 1 wherein the free cross section of at least one of the holes is at least approximately 15 $mm^2$.

13. A method comprising electrolytic treatment of a flowable medium in the electrolysis device of claim 1.

14. The method of claim 13 wherein the method comprises chlor-alkali electrolysis.

* * * * *